United States Patent [19]

Third et al.

[11] Patent Number: 4,612,527

[45] Date of Patent: Sep. 16, 1986

[54] ELECTRIC POWER TRANSFER SYSTEM

[75] Inventors: Sinclair M. Third, Wantage; Edward Abel, Newbury, both of England

[73] Assignee: United Kingdom Atomic Energy Authority, London, England

[21] Appl. No.: 639,337

[22] Filed: Aug. 10, 1984

[51] Int. Cl.[4] ..... H01F 33/00; H01F 17/04

[52] U.S. Cl. ..... 336/5; 336/119; 336/120; 336/133

[58] Field of Search ..... 336/117, 118, 119, 120, 336/133, 134, 135, 160, 165, 58, 5, 10, 12, 214, 215; 323/347, 348, 361, 332, 333, 334, 335

[56] References Cited

U.S. PATENT DOCUMENTS

| | | | |
|---|---|---|---|
| 2,771,587 | 11/1956 | Henderson | 336/160 |
| 3,147,455 | 9/1964 | Owen | 336/133 |
| 3,178,696 | 4/1965 | Claflin, Jr. | 336/133 X |
| 3,287,677 | 11/1966 | Mohr | 336/58 X |
| 3,295,084 | 12/1966 | Honstman | 336/165 |
| 3,502,966 | 3/1970 | Perets et al. | 336/133 X |
| 3,657,678 | 4/1972 | Schwenden | 336/160 |
| 3,921,114 | 11/1975 | Bridewell et al. | 336/120 X |
| 4,004,251 | 1/1977 | Hesler et al. | 336/135 X |
| 4,206,434 | 6/1980 | Hase | 336/165 X |

FOREIGN PATENT DOCUMENTS

| | | |
|---|---|---|
| 2214865 | 10/1973 | Fed. Rep. of Germany . |
| 413356 | 7/1934 | United Kingdom . |
| 1239290 | 7/1971 | United Kingdom . |
| 1587531 | 4/1981 | United Kingdom . |

*Primary Examiner*—Thomas J. Kozma
*Attorney, Agent, or Firm*—William R. Hinds

[57] ABSTRACT

An electric power transfer system in the form of a transformer comprises a first core portion 12 with two or more regions 14, and a second core portion 34 movable relative to the first core portion 12 and providing a low reluctance flux path between the regions 14. Primary windings 10 are wound around the first portion 12 of the core, and secondary windings 20 wound around the second portion 34. The regions 14 may extend along a path along which power is to be supplied, and that path may be straight, curved or circular.

7 Claims, 22 Drawing Figures

Fig.16.
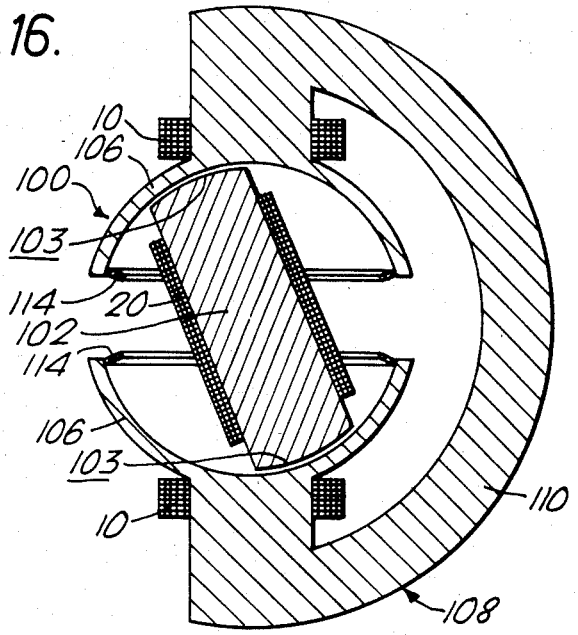
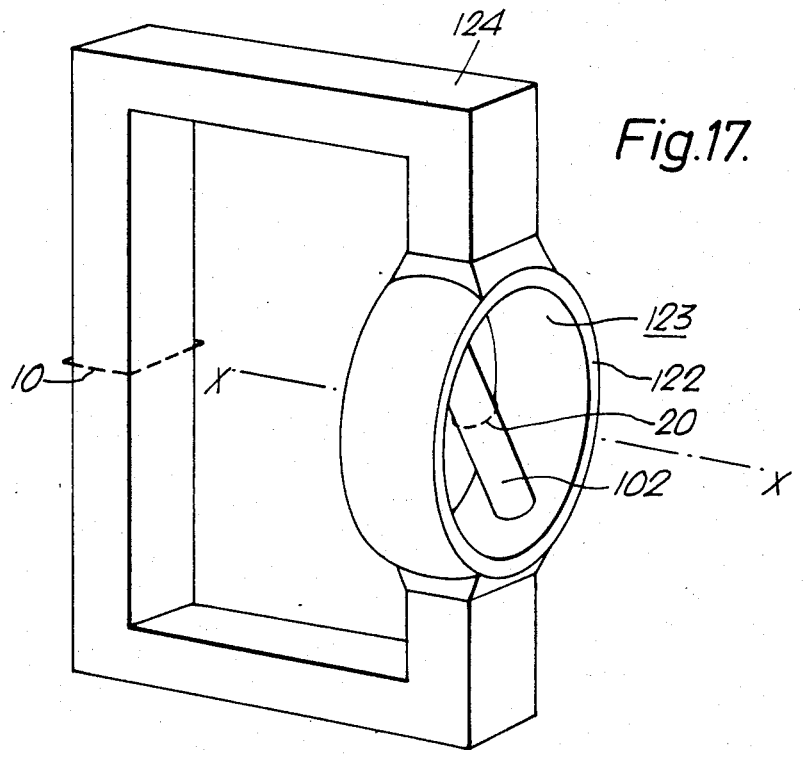
Fig.17.

Fig. 18.
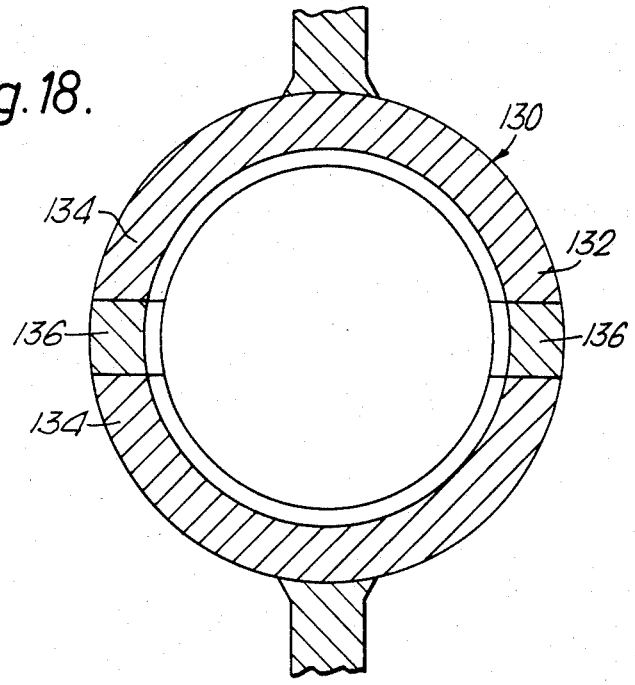
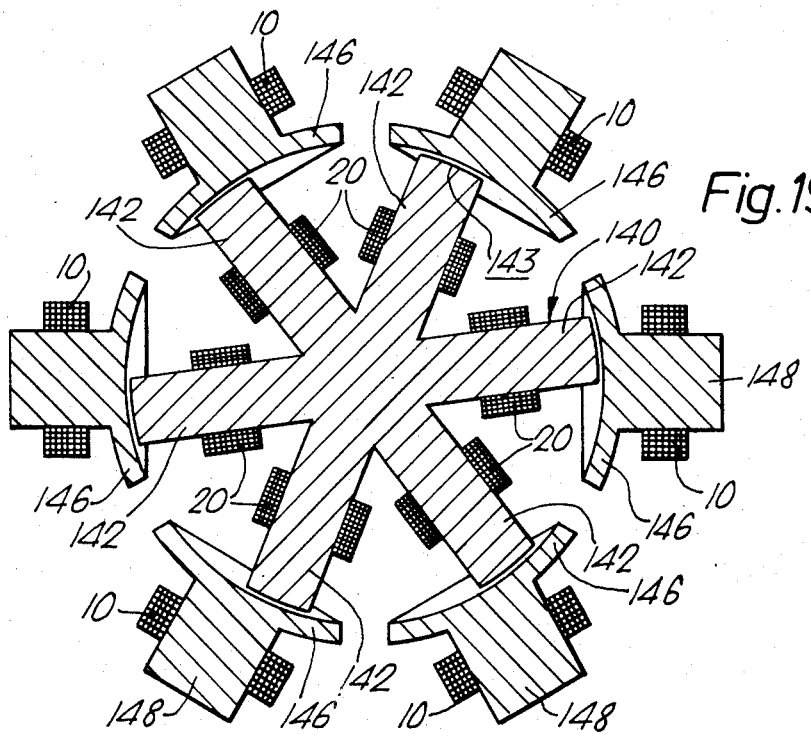
Fig. 19.

ELECTRIC POWER TRANSFER SYSTEM

This invention relates to a system for transferring electric power from an electric source to an electrical device which is movable relative to the source.

Two known techniques for transferring electric power from a stationary source to a movable electric device, involve either the use of flexible cable links, or the use of brushes making contact with conductor rails. Cables may suffer fatigue due to repeated flexing, or encounter obstructions in use, and brushes may cause sparking and become contaminated with particulate material, thus making reliable electrical contact difficult.

According to one aspect of the present invention, an alternating current electric power transformer system comprises a transformer means, the transformer means comprising a first magnetic core portion defining at least three spaced-apart regions thereof which extend in a direction along which power supply is to be provided, a first winding wound around each region of the first core portion, a second magnetic core portion of limited extent in the said direction, providing a low reluctance flux path between the spaced-apart regions of the first core portion so as to complete a magnetic flux circuit therewith, and being movable relative to the first core portion along the said direction, at least three second windings wound around the second core portion whereby polyphase electric power may be transferred, and an auxiliary primary winding wound around each region of the first core portion remote from the first winding.

In a second aspect, the invention provides an alternating current electric power transfer system comprising a transformer means, the transformer means comprising a plurality of first magnetic core portions each defining at least two spaced-apart regions thereof which extend in a straight line in parallel relationship to each other in a direction along which power supply is to be provided, the first core portions being arranged end to end such that the regions of each core portion are aligned with the regions of the adjacent core portion, a primary winding wound around each first core portion, and an auxiliary primary winding wound aroung each first core portion remote from the respective primary winding, a second magnetic core portion of limited extent in the said direction, movable relative to all the first core portions in sequence and providing a low reluctance flux path between the regions of the first core portion to which the second core portion is adjacent so as to complete a magnetic flux circuit therewith, and a secondary winding wound around the second core portion.

The invention will now be further described by way of example only with reference to the accompanying drawings in which.

Figure 5A:
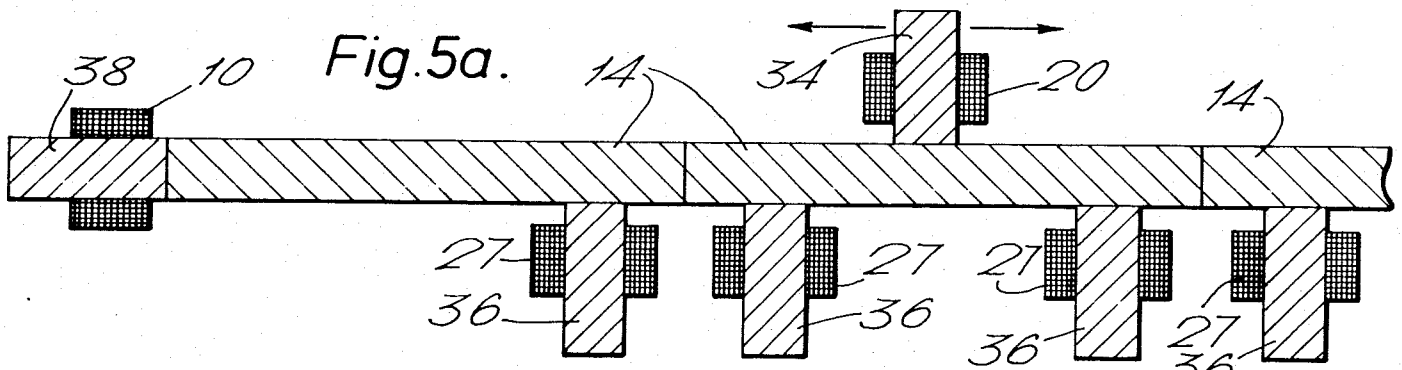
FIG. 5 shows a plan view of a modification of the system of FIG. 4.
Figure 5:
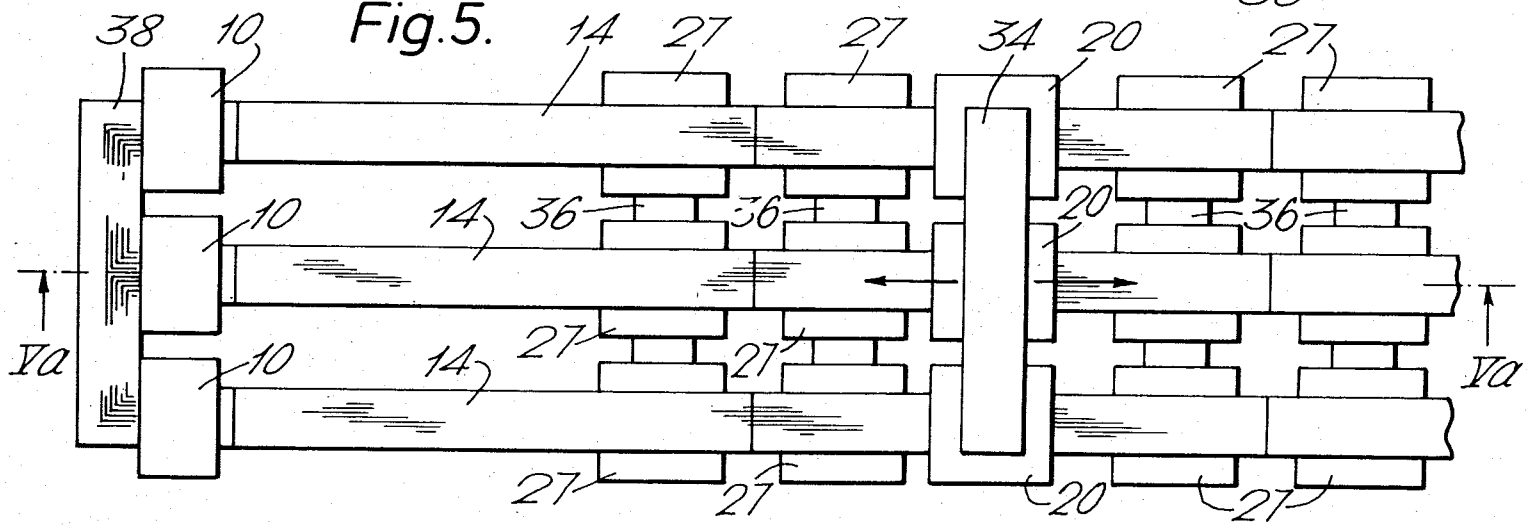
Figure 6:
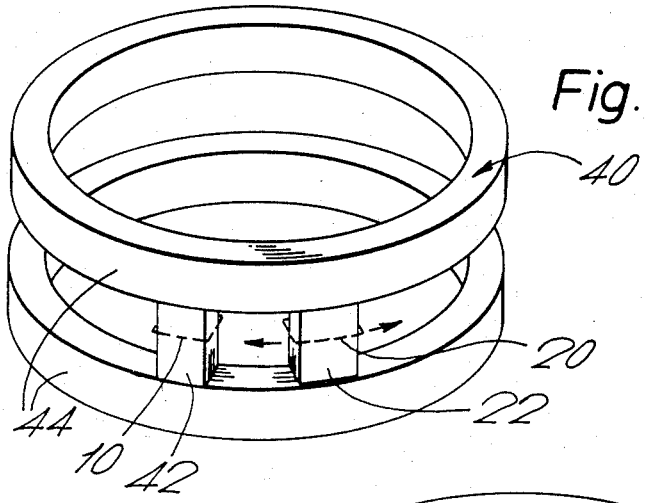
Figure 7:
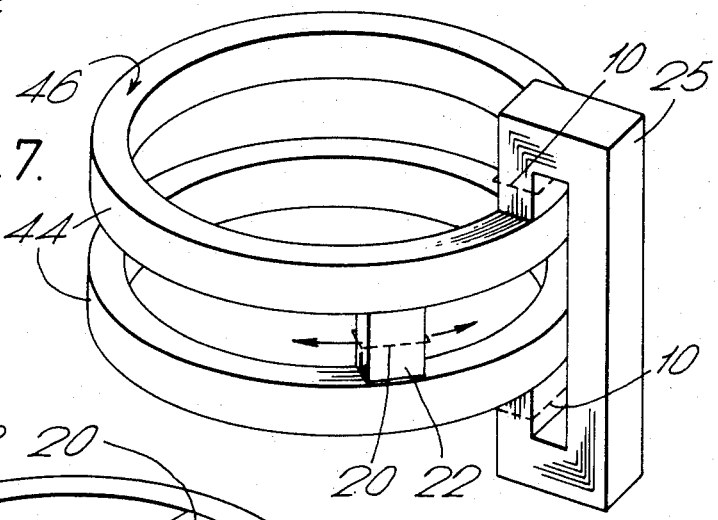
Figure 8:
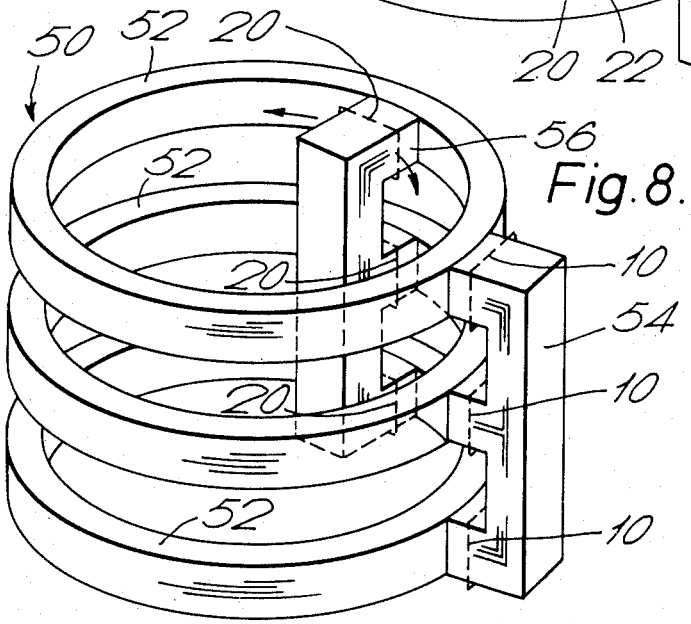
Figure 9:
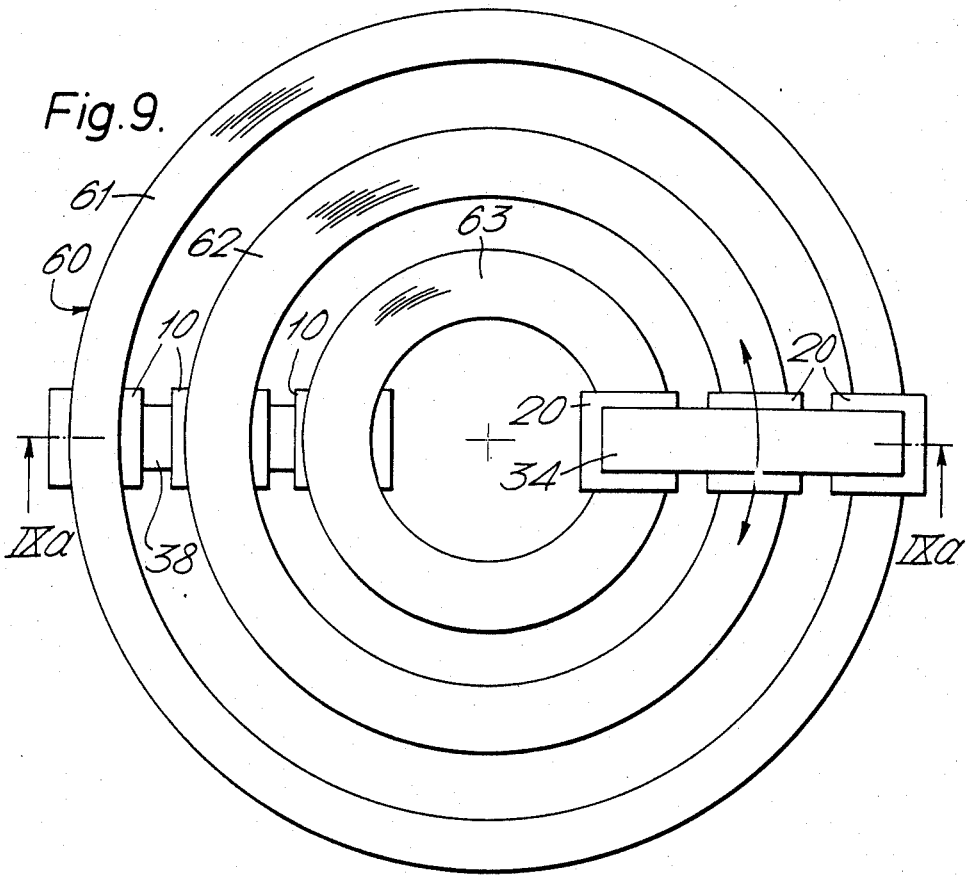
Figure 9A:
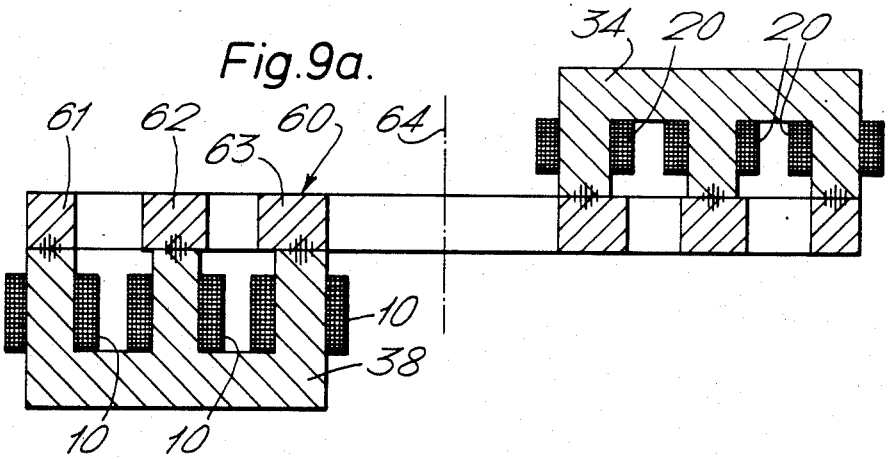
Figure 10:
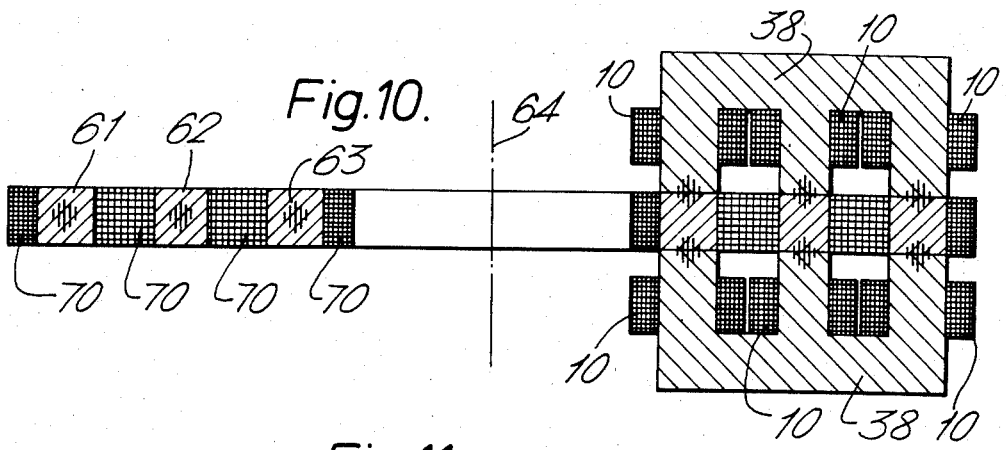
Figure 11:
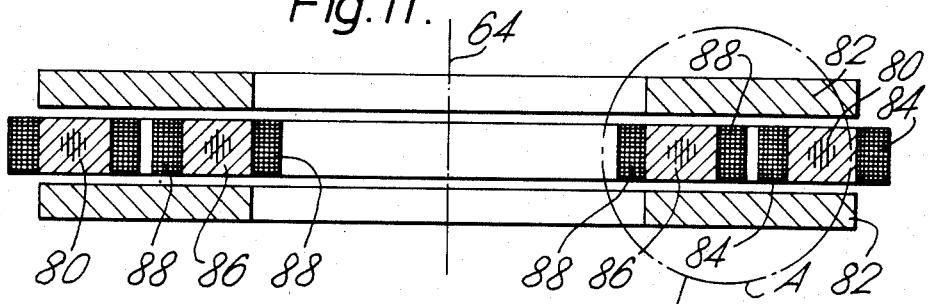
Figure 11A:
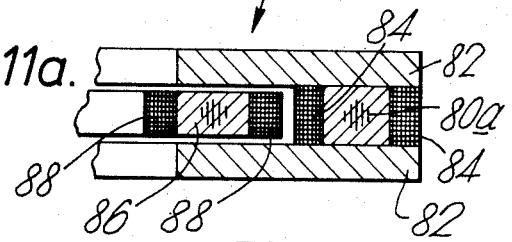
Figure 12:
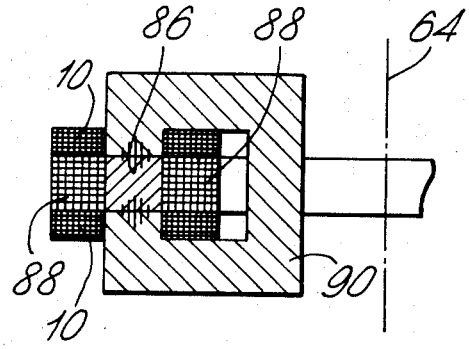
Figure 13:
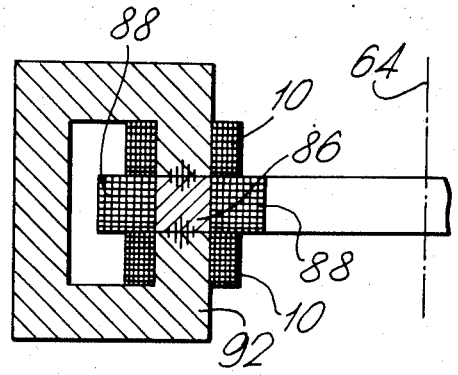
Figure 14:
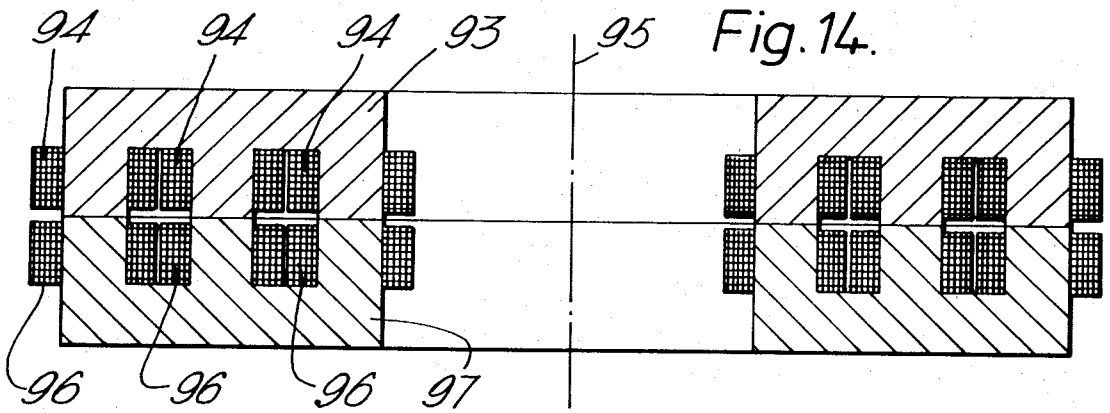
Figure 15:
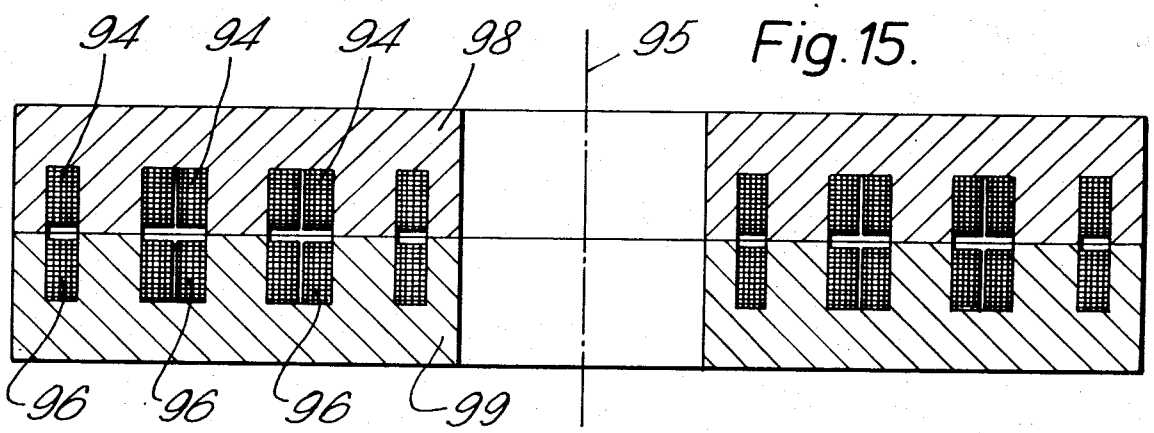

FIG. 5*a* shows a sectional view along the line Va—Va of FIG. 5;

FIGS. 6, 7 and 8 shows perspective representations of rotary electric power transfer systems;

FIG. 9 shows a plan view of a three-phase rotary electric power transfer system;

FIG. 9*a* shows a sectional view along the line IX-a—IXa of FIG. 9;

FIGS. 10 and 11 show medial sectional views of alternative rotary electric power transfer systems;

FIG. 11*a* shows a fragmentary sectional view of a modification of that portion within the circle 'A' of FIG. 11;

FIGS. 12 and 13 show fragmentary medial sectional views of modifications of the rotary electric power transfer system of FIG. 11;

FIGS. 14 and 15 show medial sectional views of high frequency electric power transfer systems;

FIG. 16 shows a sectional view of an alternative power transfer system;

FIG. 17 shows a perspective view of a modification of the system of FIG. 16;

FIG. 18 shows a sectional view of part of a modification of the system of FIG. 17; and FIG. 19 shows a sectional view of a further modification of the system of FIG. 16.

In the above figures, like parts have like numerals.

Figure 1:
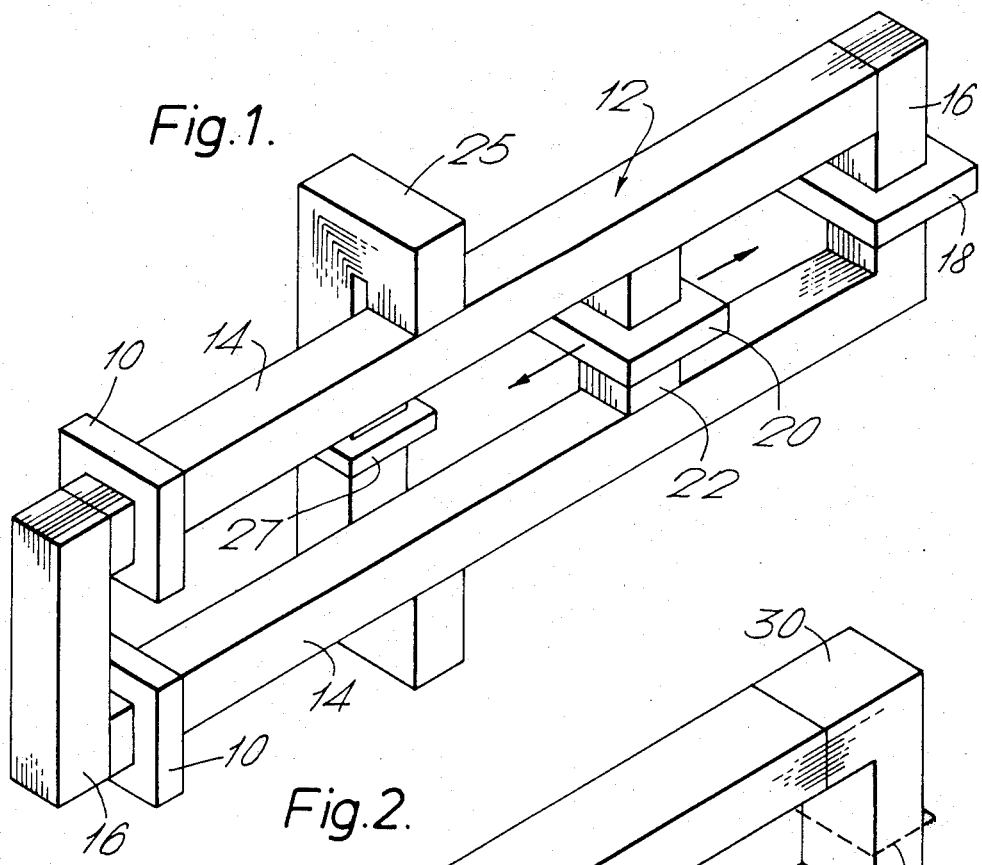
FIGS. 1 and 2 show perspective representations of single phase electric power transfer systems.

Referring now to FIG. 1, a single phase power transfer system comprises primary windings 10 wound onto a magnetic core portion 12 formed from straight, elongate laminated iron bars 14 extending parallel to and adjacent to each other and linked at each end by short laminated iron bars 16. (Note: Short lines drawn on the bars 14 and 16 represent the direction of the laminations). An auxiliary primary winding 18 is provided at the end of the core portion 12 furthest from the primary windings 10 and a secondary winding 20 is wound onto a laminated iron member 22 which extends between the bars 14 and is movable in a direction parallel to the bars 14 as shown by the arrows, the member 22 providing a low reluctance magnetic path between the regions of the magnetic core portion 12 defined by the bars 14.

When the primary windings 10 are connected to a source (not shown) of alternating current with a frequency of for example 50 Hz, an alternating magnetic flux passes through the magnetic core portion 12 and also through the low reluctance magnetic path provided by the member 22. An alternating electromotive force (e.m.f.) will therefore be induced in the secondary windings 20, and may be used to provide electric power to an electrical device (not shown). Some magnetic flux leakage from the bars 14 can be expected. Hence if the member 22 is far from the primary windings 10, it may be necessary to augment the flux from the primary windings 10 by energising the auxiliary primary winding 18. The problems due to magnetic leakage become more significant the longer the bars 14, and one solution is to provide a C-shaped laminated iron core 25 magnetically linking the bars 14 and onto which an additional primary winding 17 is wound. It should be possible to have a multiplicity of such C-cores 25 along the length of the power transfer system, and if necessary the local additional primary windings 27 could be switched in as the member 22 approached. If required, the member 22 could be turned about its longitudinal axis.

An alternative system (not shown) similar to that of FIG. 1, has the secondary winding 20 wound onto the C-core 25 which is made movable along the long bars 14, and if necessary has additional primary windings 18 wound on static members 22.

Figure 2:
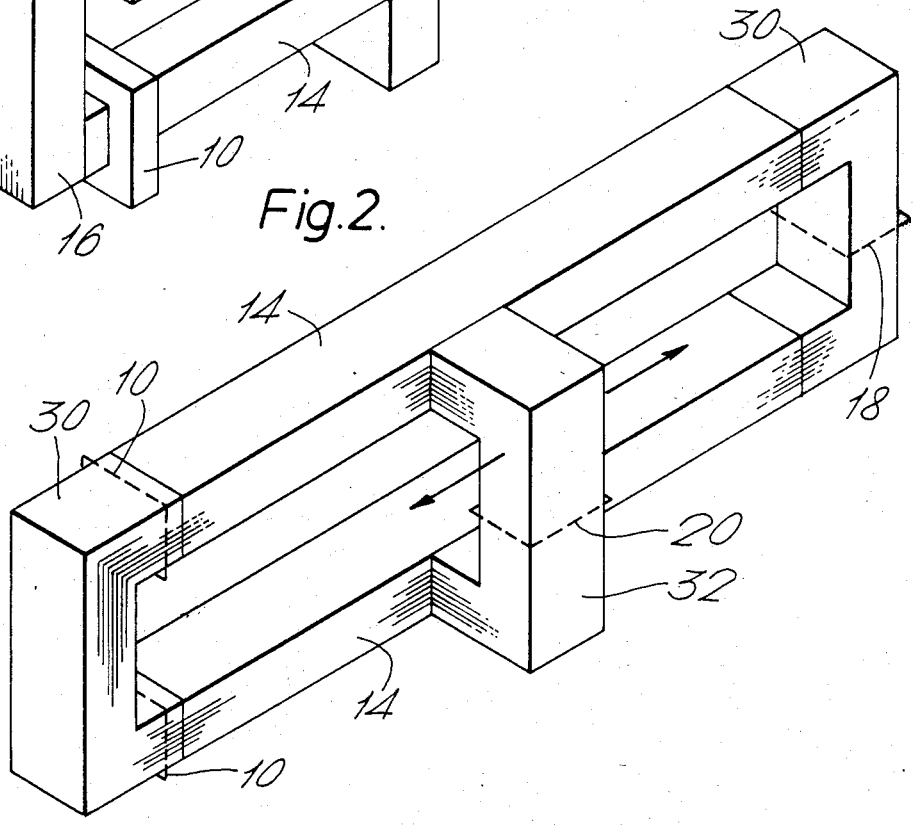

In FIG. 2 is a slightly different single phase power transfer system from that of FIG. 1, the main difference being in the plane of the laminations which are indicated in the same manner as in FIG. 1. The system comprises primary windings 10 (all the windings being represented by broken lines) wound onto a laminated end portion 30. Two straight, elongate laminated iron bars 14 extend from the end portion 30, and at their far end are linked by another end portion 30 onto which an auxiliary primary winding 18 may be wound. A secondary winding 20 is wound onto a C-shaped laminated iron core 32 which makes wiping contact along the sides of the bars 14.

The power transfer system of FIG. 2 operates in a similar manner to that of FIG. 1, the C-core 32 providing a low reluctance flux path between the bars 14. If it is found necessary to augment the magnetic flux from the primary windings 10, this may be done by energising the auxiliary primary winding 18, or by energising additional primary windings (not shown) wound on C-shaped laminated iron cores (not shown) similar to the C-core 32 but fixed to the bars 14 on the other side to that of the C-core 32.

Figure 3:
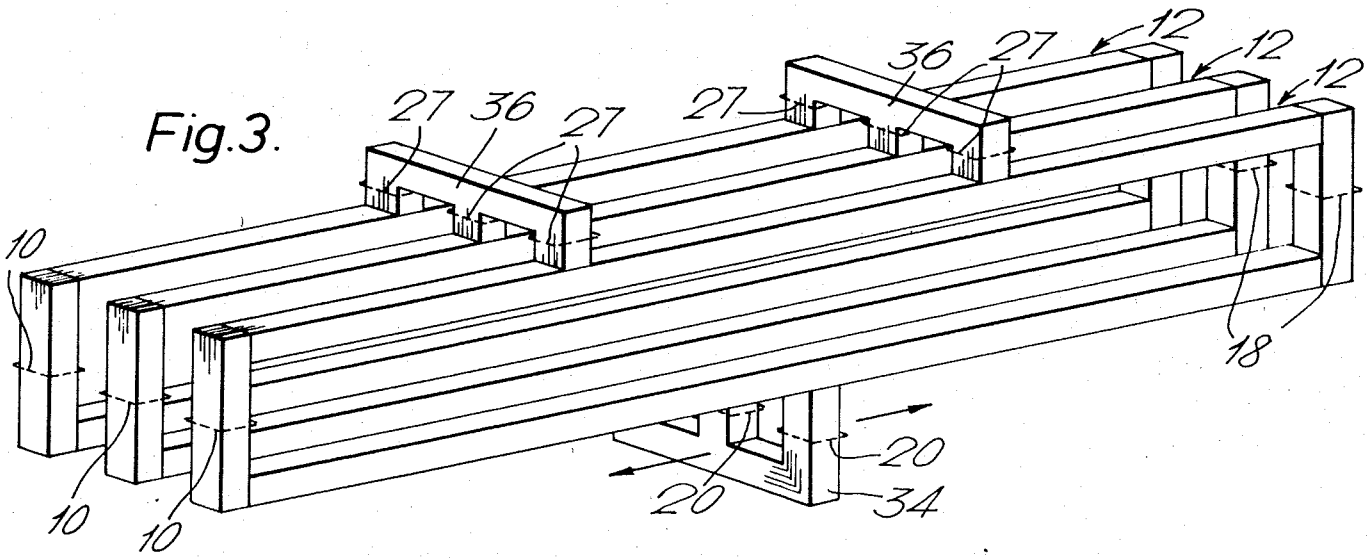
FIGS. 3 and 4 show perspective representations of three-phase electric power transfer systems.

A three-phase power transfer system may be arranged as in FIG. 3 utilising three magnetic core portions 12 of FIG. 1, three primary windings 10 and, if required, three auxiliary primary windings 18 (only two are shown). Three secondary windings 20 (only two are shown) are wound onto a laminated iron E-shaped core 34, the E-core 34 being slidable along the magnetic core portions 12.

If required, additional primary windings 27 may be wound on fixed laminated iron E-shaped core 36 linking the magnetic core portions 12 and spaced along their length on the opposite side to that of the slidable E-core 34.

Figure 4:
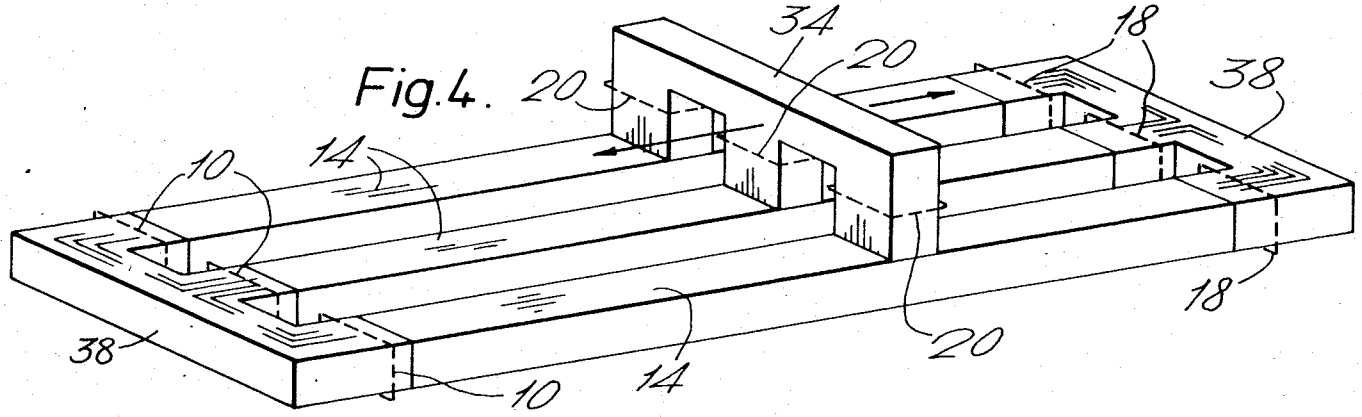

In FIG. 4 is shown a simpler design of three-phase power transfer system comprising three elongate bars 14 linked at each end by laminated iron E-shaped cores 38. On one E-core 38 three primary windings 10 are wound, and three auxiliary primary windings 18 are wound on the other E-core 38. Three secondary windings 20 are wound on a laminated iron E-shaped core 34 which is slidable along the top side of the bars 14.

The elongate bars 14 may be 50 mm thick, 75 mm wide and 2 m long. If a longer power transfer system is required, the design of FIG. 4 may be modified as shown in FIGS. 5 and 5*a* by laying the bars 14 end to end to the required length, primary windings 10 being wound onto an E-shaped core 38 at one end of the system and additional primary windings 27 being wound onto E-shaped cores 36 on the underside of the bars 14. The E-cores 36 are situated on either side of every butt joint between adjacent bars 14. As in the system of FIG. 4, secondary windings 20 are wound on an E-shaped core 34 which is slidable along the upper side of the bars 14. Only the primary windings 10 or additional primary windings 27 in the vicinity of the E-core 34 need by energised. Sequential energising of the additional primary windings 27 produces the effect of a magnetic commutator.

In the power transfer systems described with reference to FIGS. 1 to 5, straight bars 14 are used to define regions of the stationary magnetic core portions. In these systems, the path along which the secondary windings 20 move and along which electrical power is available is a straight line. It will be understood that where electrical power must be supplied along a curved path, the elongate bars 14 may themselves be curved. Alternatively, elongate bars 14 may be laid end to end, as in the system of FIG. 5, but so as to define a generally curved path. In each case, the two or more regions of the stationary core portion 12 must be separated by a constant distance along their length.

FIGS. 6, 7 and 8 show representations of rotary power transfer systems, FIGS. 6 and 7 being analogous to the system of FIG. 1, and FIG. 8 analogous to that of FIG. 4. Referring to FIG. 6, the rotary single phase power transfer system shown comprises a magnetic core portion 40 formed from a static laminated iron member 42 linking two regions provided by identical co-axial laminated iron rings 44, the laminations forming concentric rings about the longitudinal axis of the rings 44. A primary winding 10 is wound on the member 42, and a secondary winding 20 wound on a laminated iron member 22 linking the rings 44 and slidable between the rings 44, the member 22 being limited in its movement by the member 42. In FIG. 7 a single phase power transfer system is shown similar to that of FIG. 6 but differing from that of FIG. 6 in that primary windings 10 are wound onto a C-shaped core 25 linking two laminated iron co-axial rings 44. The C-core 25 and the rings 44 constitute a stationary magnetic core portion 46, hence the member 22 and the secondary windings 20 can undergo continuous movement between the rings 44.

As in the systems of FIGS. 1 to 5, when an alternating current is passed through the primary windings 10, an alternating magnetic flux passes through the magnetic core portion 40 or 46 and also through the member 22 on which the secondary winding 20 is wound, since the member 22 provides a low reluctance flux path between the rings 44. An alternating e.m.f. will therefore be induced in the secondary windings 20.

Referring now to FIG. 8, a rotary three-phase power transfer system comprises a stationary magnetic core portion 50 having regions defined by three identical co-axial laminated iron rings 52, the laminations being in planes perpendicular to the longitudinal axis of the rings 52, and linked by an E-shaped core 54 having arms curved concavely at the ends to conform to the adjacent peripheries of the rings 52. Primary windings 10 are wound onto the arms of the E-core 54. Inside the rings 52 and slidable around them is an E-shaped core 56 having arms curved convexly at the ends to conform to the inside surface of the rings 52. Three secondary windings 20 are wound on the arms of the E-core 56.

The system of FIG. 8 provides for continuous rotation of the E-core 56 around the rings 52 and operates in a similar manner to the systems of FIGS. 6 and 7. It will be appreciated that if space is limited the E-core 54 may be replaced by three short radial stubs (not shown) in place of the arms of the E-core 54 on which the primary windings 10 are wound. Magnetic flux between the rings 52 which would otherwise have followed a low reluctance path through the stem of the E-core 54 will instead emerge from the stubs and follow a path through the air.

Rotary power transfer systems (not shown) similar to those of FIGS. 7 and 8 have the secondary windings wound onto a C-core 25 and onto an E-core 54 respectively, which are movable relative to iron rings 44 and 52 respectively, and have primary windings wound onto a stationary iron member 22 and a stationary E-core 56 respectively.

Referring to FIGS. 9 and 9*a*, an alternative rotary three-phase power transfer system comprises a stationary magnetic core portion 60 formed from three concentric co-planar laminated iron rings 61, 62 and 63 having concentric laminations linked by an E-shaped core 38 below the rings 61,62, and 63. Primary windings 10 are wound on the arms of the E-core 38. Above the rings 61, 62 and 63 is an E-shaped core 34 slidable around the rings 61, 62, and 63, and providing a low reluctance flux path between them. Secondary windings 20 are wound onto the arms of the E-core 34.

The system of FIG. 9 provides for continuous rotation of the secondary windings 20 about the axis 64 of the iron rings 61, 62, 63, and requires rather less height than the system of FIG. 8 while operating in a similar manner to the system of FIG. 8.

Referring to FIG. 10, an alternative rotary three-phase power transfer system comprises two E-shaped cores 38, which constitute a stationary magnetic core portion, primary windings 10 being wound on the arms of the E-cores 38. In between the two E-cores 38 are three concentric co-planar laminated iron rings 61, 62 and 63, rotatable about their longitudinal axis 64 and providing low reluctance flux paths between regions defined by the respective arms of the E-cores 38. Secondary windings 70 are wound concentrically around the rings—inside ring 63, between rings 63 and 62 and between rings 62 and 61, and outside ring 61.

The power transfer system of FIG. 10 operates in a similar manner to that of the aforedescribed systems, an alternating current flowing through the primary windings 10 of FIG. 10 causing an alternating flux to pass both through the stationary E-cores 38 and also through at least a section of the rings 61, 62 and 63. An alternating e.m.f. is therefore induced in the secondary windings 70.

In FIG. 11 is shown a diagram of a low profile rotary single phase power transfer system comprising a laminated iron ring 80 and two identical co-axial annular iron plates 82 above and below the ring 80. Primary windings 84 are wound concentrically inside and outside the ring 80. A second laminated iron ring 86 is rotatably mounted inside the iron ring 80, and is co-axial and co-planar therewith. Secondary windings 88 are wound concentrically inside and outside the ring 86. As shown in FIG. 11*a*, the annular plates 82 may be attached to the top and bottom surfaces respectively of an iron ring 80*a*, slightly thicker than the iron ring 80.

The annular plates 82 provide a mechanical shield for the secondary windings 88 and rotatable ring 86, and also provide a flux path between the two rings 80 or 80*a* and 86—they constitute the regions of a stationary core portion.

Referring now to FIGS. 12 and 13, which represent single phase rotary power transfer systems, secondary windings 88 as in FIG. 11 are wound inside and outside an iron ring 86 and are rotatable about the longitudinal axis 64 of the ring 86. The systems differ from that of FIG. 11 in having primary windings 10 wound onto laminated iron C-shaped cores 90 and 92 respectively which define regions thereof each side of the ring 86. In the system of FIG. 12 each C-core 90 extends inside the iron ring 86, unlike the system of FIG. 13 in which the C-core 92 extends outside the iron ring 86.

Operation of the power transfer system at higher frequencies, for examples 5 kHz, enables smaller cores to be used to transmit the same power and increases the efficiency of the system. In addition, cores may be made of a ferrite or iron powder, rather than laminated iron. As examples, FIGS. 14 and 15 show sectional views of low profile three-phase high frequency rotary power transfer systems. Both systems comprise concentric, co-planar, primary windings 94, and concentric, co-planar secondary windings 96 having the same radial dimensions as those of the primary windings 94. In FIG. 14 the primary windings 94 and secondary windings 96 are wound into concentric annular slots in respective opposed disc-shaped ferrite cores 93 and 97, the outermost and innermost windings 94, 96 being exposed. The core 97 is rotatable with respect to the core 93 about the longitudinal axis 95 of the cores 93, 97. The system of FIG. 15 differs from that of FIG. 14 in having disc-shaped cores 98 and 99 each with four concentric slots into which the primary windings 94 and secondary windings 96 are wound. The enclosure of the innermost and outermost windings within the cores 98 and 99 decreases the reluctance in the magnetic circuit, and also reduces radiation of high frequency electromagnetic radiation.

If desired, the high frequency e.m.f. induced in the secondary windings 96 of FIGS. 14 and 15 may be subsequently converted to 50 or 60 Hertz using for example a controlled rectifier and a direct current link inverter.

In order to reduce the air gap between the magnetic core portions, a magnetic liquid such as Ferrofluid may be introduced between the portions. However, when the power transfer system is de-energised, an auxiliary low power electric supply may be necessary to provide sufficient residual magnetism in the core portions to retain the Ferrofluid.

In some applications of the invention a relatively thin non-magnetic material may be interposed between the first core portion and the second core portion, for example the wall of a tank enclosing a radioactive environment.

Where movement about more than one axis is required, the regions of a stationary magnetic core portion may be spherically concave so as to define parts of a spherical surface, and the adjoining portions of a movable magnetic core portion may be correspondingly spherically convex. In FIG. 16, to which reference is now made, a single phase power transfer system 100 is shown permitting limited rotation of a movable core portion about two perpendicular axes. The movable core portion is a cylindrical ferrite rod 102 with spherically convex ends 103 whose centre of curvature is at the mid point of the rod 102. A secondary winding 20 is wound around the rod 102, and the rod 102 is rotatably located between opposed spherically concave ferrite caps 106 defining the regions of a stationary magnetic core portion 108 and with which the convex ends 103 mate, the caps 106 being joined by a generally C-shaped ferrite core 110. Primary windings 10 are wound around the ends of the ferrite core 110 adjacent to the caps 106. A guard ring 114 around the rim of each cap 106 prevents excessive rotation of the rod 102.

The rod 102 provides in operation a low reluctance flux path between the caps 106, so completing the magnetic flux circuit for the magnetic field set up by the primary windings 10. The rod 102 is rotatable about two perpendicular axes through its mid point and perpendicular to its longitudinal axis, within the limits set by the guard rings 114, and is also rotatable around its longitudinal axis.

It will be appreciated that if space is limited the C-shaped core 110 joining the caps 106 may be dispensed with, the primary windings 10 being wound around short stub cores (not shown) extending radially from the caps 106, the magnetic flux which would otherwise have flowed through the C-shaped core 110 instead emerging from the stub cores and flowing through the surrounding air.

Referring now to FIG. 17 a power transfer system 120 is shown, similar in some respects to that of FIG. 16, comprising a movable core portion in the form of a cylindrical ferrite rod 102 with spherically convex ends (not shown) whose centre of curvature is at the mid point of the rod 102, and having secondary windings 20 wound around it. The rod 102 is rotatably and diametrically located within a ferrite ring member 122 whose inside surface 123 is spherically concave, the convex ends of the rod mating with the inside surface 123. A generally C-shaped ferrite core 124 joins two diametrically opposite parts of the ring member 122, and primary windings 10 are wound around the C-shaped core 124. The ferrite material of the rod 102 is of lower reluctance than the ferrite material of the ring member 122 so that the rod 102 provides a lower reluctance path for magnetic flux than the portions of the ring member 122 with which it is in parallel in respect of the magnetic circuit.

The rod 102 is thus free to rotate continuously about the axis X—X of the ring member 122, and can rotate within limits set by the edges of the ring member 122 about two perpendicular axes through the centre of the rod 102. Except when it is in the horizontal plane (the ring member 122 being in the orientation shown in the Figure), magnetic flux due to alternating current in the primary windings 10 will pass along the low reluctance flux path provided by the rod 102, and an e.m.f. will be induced in the secondary windings 20.

In FIG. 18 a partial sectional view of a power transfer system 130 is shown, differing from that of FIG. 17 only in that the ring member 122 of FIG. 17 is replaced by a ring member 132 of the same shape but comprising two low reluctance ferrite portions 134 joined by two non-ferromagnetic portions 136 diametrically opposite each other and of width slightly greater than the diameter of the rod 102 of FIG. 17. The power transfer system 130 operates in the same manner as that of FIG. 17, an e.m.f. being induced in secondary windings 20 except when the rod 102 lies in the diametral plane between the non-ferromagnetic portions 136.

In FIG. 19 a power transfer system is shown analogous to that of FIG. 16 but for three-phase alternating current, and comprises a movable core portion in the form of a ferrite star member 140, with six equally spaced co-planar cylindrical limbs 142. The limbs 142 have spherically convex ends 143 with a centre of curvature at the centre of the star member 140. Secondary windings 20 are wound around each limb 142, those on opposite limbs 142 being connected electrically. The ferrite star member 140 is rotatably located by six spherically concave ferrite caps 146, the end 143 of each limb 142 mating with one of the caps 146. Pairs of diametrically opposite caps 146 are joined by three generally C-shaped ferrite cores 148, which are all joined together in a star shape at their mid points (not shown). Primary windings 10 are wound around each end of each C-shaped core 148 adjacent to each cap 146, those on opposite ends of each C-shaped core 148 being connected electrically.

The ferrite star member 140 provides in operation three low reluctance flux paths between pairs of opposing caps 146, so that if three phase alternating current is supplied to the three sets of primary windings 10, three phase alternating e.m.fs. are induced in the three sets of secondary windings 20. It will be appreciated that the ferrite star member 140 is rotatable about three perpendicular axes through the centre of the star member 140, but that all of its motions need to be limited by the edges of the caps 146, because if the star member 140 rotates so far that one or more pairs of diametrically opposite limbs 142 are no longer adjacent to the respective caps 146 then an e.m.f. is not induced in the corresponding secondary windings 20. To prevent this occurring, guard rings 114 (shown in FIG. 16) may be provided around the edge of each cap 146.

We claim:

1. An alternating current electric power transfer system comprising a transformer means, said transformer means comprising: a first magnetic core portion defining at least three spaced-apart regions thereof which extend in a direction along which power supply is to be provided; a first winding wound around each region of said first core portion; a second magnetic core portion of limited extent in the said direction, providing a low reluctance flux path between the spaced-apart regions of the first core portion so as to complete a magnetic flux circuit therewith, and being movable relative to the first core portion along the said direction; at least three second windings wound around the second core portion, whereby polyphase electric power may be transferred; and an auxiliary primary winding wound around each region of the first core portion remote from the first winding.

2. A power transfer system as claimed in claim 1, wherein a magnetic liquid is located between the first core portion and the second core portion.

3. A power transfer system as claimed in claim 2, including an auxiliary relatively low power source for magnetising the first core portion and the second core portion.

4. A power transfer system as claimed in claim 1, wherein a relatively thin non-magnetic material is interposed between the first core portion and the second core portion.

5. A power transfer system as claimed in claim 1, wherein both the first core portion and the second core portion are of ferrite.

6. An alternating current electric power transfer system comprising a transformer means, said transformer means comprising: a plurality of first magnetic core portions each defining at least two spaced-apart regions thereof which extend in a straight line in parallel relationship to each other in a direction along which power supply is to be provided, the first core portions being arranged end to end such that the regions of each core portion are aligned with the regions of the adjacent core portion; a primary winding wound around each first core portion, and an auxiliary primary winding wound around each first core portion remote from the respective primary winding; a second magnetic core portion of limited extent in the said direction, movable relative to all the first core portions in sequence and providing a low reluctance flux path between the regions of the first core portion to which the second core portion is adjacent so as to complete a magnetic flux circuit therewith; and a secondary winding would around the second core portion.

7. A power transfer system as claimed in claim 6, wherein only the primary winding adjacent to the second core portion is arranged in operation to be energised.

* * * * *